US009685286B2

(12) United States Patent
Kimura et al.

(10) Patent No.: US 9,685,286 B2
(45) Date of Patent: Jun. 20, 2017

(54) KEYBOARD DEVICE

(71) Applicant: SONY CORPORATION, Tokyo (JP)

(72) Inventors: Yasunori Kimura, Nagano (JP); Shuichi Chihara, Nagano (JP); Yasushi Tsuji, Nagano (JP); Junichiro Misawa, Nagano (JP); Shingo Harada, Nagano (JP)

(73) Assignee: Sony Corporation, Tokyo (JP)

( * ) Notice: Subject to any disclaimer, the term of this patent is extended or adjusted under 35 U.S.C. 154(b) by 194 days.

(21) Appl. No.: 14/466,121

(22) Filed: Aug. 22, 2014

(65) Prior Publication Data

US 2015/0060250 A1 Mar. 5, 2015

(30) Foreign Application Priority Data

Sep. 3, 2013 (JP) ..... 2013-182348

(51) Int. Cl.
*H01H 13/705* (2006.01)
*H01H 9/44* (2006.01)
*H01H 36/00* (2006.01)

(52) U.S. Cl.
CPC ..... *H01H 13/705* (2013.01); *H01H 9/443* (2013.01); *H01H 36/00* (2013.01); *H01H 36/0073* (2013.01); *H01H 2219/037* (2013.01); *H01H 2221/002* (2013.01); *H01H 2229/03* (2013.01)

(58) Field of Classification Search
CPC ..... H01H 36/00; H01H 36/0073; H01H 36/0006; H01H 9/443; H01H 36/008; H01H 2221/04
USPC ..... 200/310–314; 335/205–207
See application file for complete search history.

(56) References Cited

U.S. PATENT DOCUMENTS 5,438,177 A * 8/1995 Fagan ..... H01H 13/702 200/5 A
2004/0007968 A1* 1/2004 Hanahara ..... H01H 13/7006 313/498
2004/0129542 A1* 7/2004 Kawaguchi ..... H01H 9/182 200/61.1
2008/0264770 A1* 10/2008 Purcocks ..... H01H 13/7065 200/521
2012/0169603 A1* 7/2012 Peterson ..... G06F 3/0202 345/168
2014/0183019 A1* 7/2014 Misawa ..... G06F 1/1616 200/5 A
2015/0034470 A1* 2/2015 Kimura ..... G06F 3/0202 200/5 A

FOREIGN PATENT DOCUMENTS

JP 2007005023 * 1/2007 ..... H01H 3/125

* cited by examiner

*Primary Examiner* — Renee Luebke
*Assistant Examiner* — Ahmed Saeed
(74) *Attorney, Agent, or Firm* — Paratus Law Group, PLLC

(57) ABSTRACT

There is provided a keyboard device including a plurality of key tops that include magnets and are depressible, an opposing member which is provided to face the plurality of key tops and in which signal lines are wired, and a plurality of openings that is formed corresponding to positions of the magnets when the key tops are pressed in the opposing member. The signal lines are wired while avoiding the openings.

12 Claims, 11 Drawing Sheets

(a)

(b)

KEYBOARD DEVICE

CROSS REFERENCE TO RELATED APPLICATIONS

This application claims the benefit of Japanese Priority Patent Application JP 2013-182348 filed Sep. 3, 2013, the entire contents of which are incorporated herein by reference.

BACKGROUND

The present disclosure relates to a keyboard device including depressible key tops.

As a keyboard device, for example, a keyboard of a personal computer including a rubber dome and a scissors mechanism is used. In such a keyboard device, if a user presses a key top, the key top supported horizontally to the scissors mechanism presses down the rubber dome. As a result, a mechanism in which an electrical connection is made in a membrane switch and an input signal is transmitted is adopted (see JP 2012-129140A).

SUMMARY

Recently, there has been a need to make a keyboard device thinner. In order to meet this need, there is proposed a method using an attraction force generated in a magnet pair, in replacement of a rubber dome and a scissors mechanism. In such a method, magnets are provided in key tops.

By the way, in a case where the magnets are provided in the key top, when the key top is pressed, the magnet may interfere with a membrane switch in which a signal line is wired. In such a case, there are concerns that the wiring of the signal line may be hindered.

Therefore, the present disclosure proposes a method which is capable of appropriately wiring signal lines while making a keyboard device thinner.

According to an embodiment of the present disclosure, there is provided a keyboard device including a plurality of key tops that include magnets and are depressible, an opposing member which is provided to face the plurality of key tops and in which signal lines are wired, and a plurality of openings that is formed corresponding to positions of the magnets when the key tops are pressed in the opposing member. The signal lines are wired while avoiding the openings.

According to the present disclosure, since the keyboard device includes the plurality of openings that is formed corresponding to the positions of the magnets when the key top is pressed in the opposing member, the magnets do not interfere with the opposing member, thereby achieving a reduction in the thickness of the keyboard device. Also, since the signal lines are wired in the opposing member such that the lines avoid the openings, it is possible to appropriately output the signals according to the pressing of the key top.

As described above, according to the present disclosure, it is possible to appropriately wire the signal lines in the opposing member facing the key top, while reducing the thickness of the keyboard device.

Incidentally, the above effect is not necessarily restrictive and, in addition to the above effect or alternative to the above effect, any effect set forth in the present specification or other effects grasped from the present specification may be achieved.

DETAILED DESCRIPTION OF THE EMBODIMENT(S)

Figure 1:
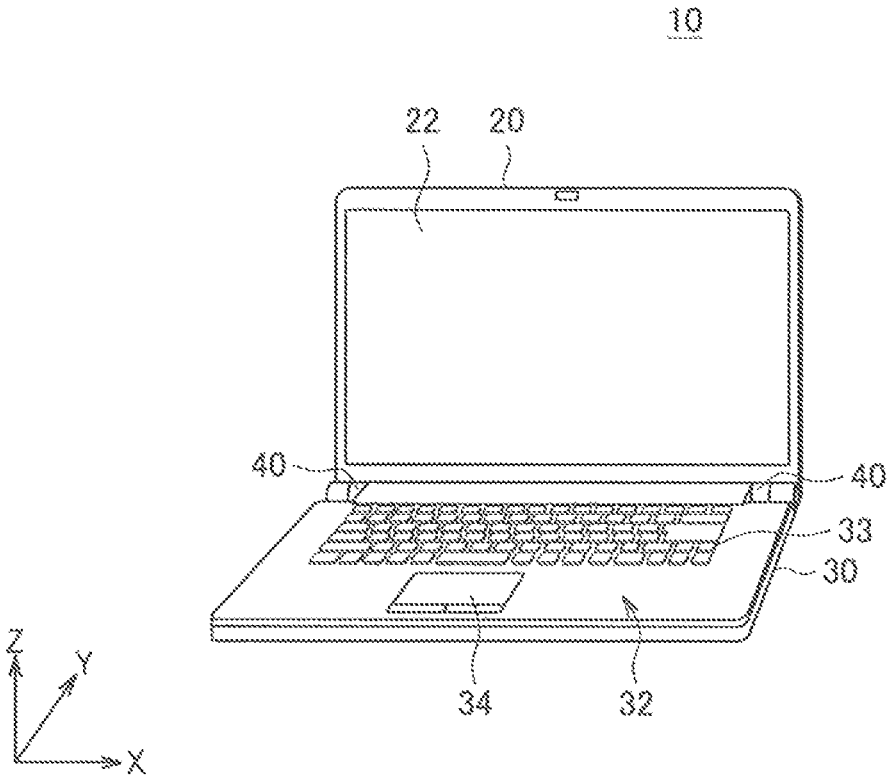
FIG. 1 is a perspective view illustrating an example of an external configuration of an electronic device 10 according to an embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Incidentally, the description will be given in the following order.

1. Configuration of Keyboard Device
2. Detailed Configuration of Keyboard Section
3. Wiring of Signal Lines in Membrane
4. Example of Movement of Keyboard Section
5. Summary <1. Configuration of Keyboard Device>

A configuration of a keyboard device according to an embodiment of the present disclosure will be described below. In the following, an electronic device 10 illustrated in FIG. 1 will be described as an example of the keyboard device.

FIG. 1 is a perspective view illustrating an example of the external configuration of the electronic device 10 according to an embodiment of the present disclosure. The electronic device 10 is, for example, a notebook personal computer. However, the electronic device 10 is not limited to the notebook personal computer, and may be, for example, a desktop personal computer.

As illustrated in FIG. 1, the electronic device 10 includes a display-side housing 20, a body-side housing 30, and a hinge mechanism section 40. For example, each of the display-side housing 20 and the body-side housing 30 is formed to have a flat-plate shape and is formed to have the same size.

The display-side housing 20 includes a display section 22. The display section 22 includes a display device such as, for example, a liquid crystal display. The display section 22 includes a display screen that displays a variety of information. Incidentally, a touch panel that allows a user to perform a touch operation may be overlapped on the display screen of the display section 22.

The body-side housing 30 includes an input section 32 that receives an input operation of a user. The input section 32 detects the input operation of the user and outputs an electric signal corresponding to the input operation. The user performs the input operation through the input section 32 when the display-side housing 20 is in an open state (FIG. 1).

Figure 2:
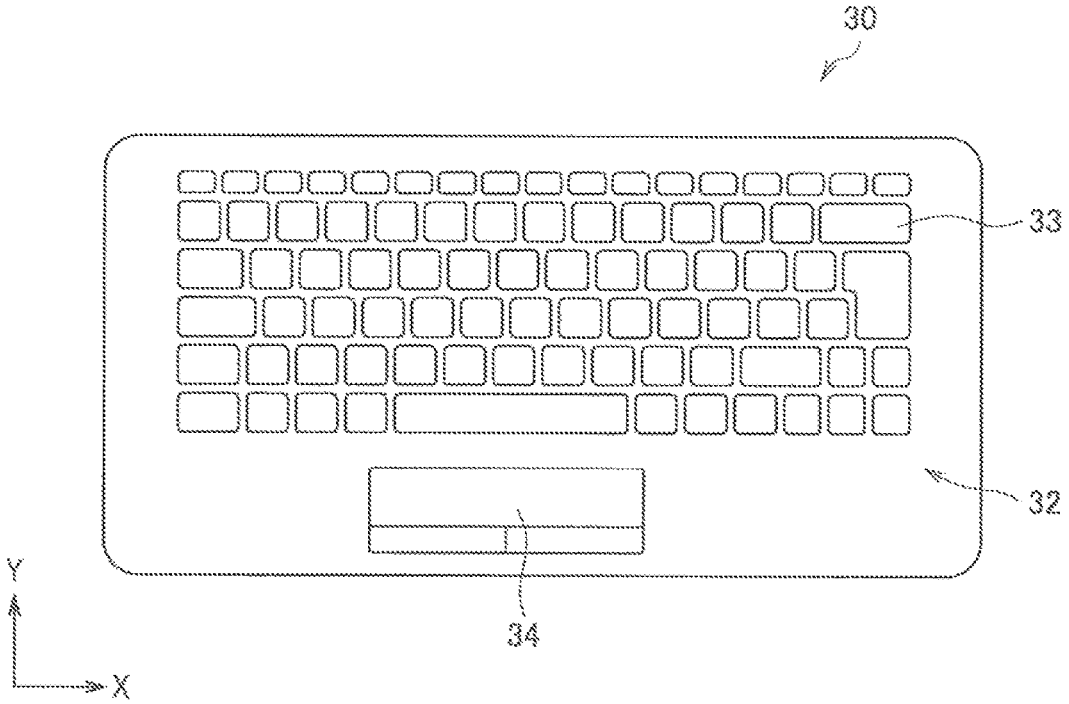
FIG. 2 is a plan view illustrating an example of a configuration of a body-side housing 30.

FIG. 2 is a plan view illustrating an example of the configuration of the body-side housing 30. As illustrated in FIG. 2, the input section 32 includes a keyboard section 33 or a touch pad section 34. The keyboard section 33 includes a plurality of operation keys that the user can press down. The touch pad section 34 is an area in which the user can perform a touch input. Incidentally, a detailed configuration of the keyboard section 33 will be described below.

The hinge mechanism section 40 pivotally connects the display-side housing 20 to the body-side housing 30. The hinge mechanism section 40 is provided on both sides of the body-side housing 30 in a longitudinal direction (X direction illustrated in FIG. 1). Due to the hinge mechanism section 40, the display-side housing 20 is pivoted between an open state of being opened with respect to the body-side housing 30 (FIG. 1) and a closed state of being closed with respect to the body-side housing 30.

Incidentally, in the above, the keyboard device has been described as being the personal computer in which the input section 32 and the display section 22 are integrally provided, but is not limited thereto. For example, the keyboard device may be a keyboard that does not include the display section 22 and includes the input section 32. That is, the keyboard device may be configured separately from the display device.

<2. Detailed Configuration of Keyboard Section 33>

Figure 3:
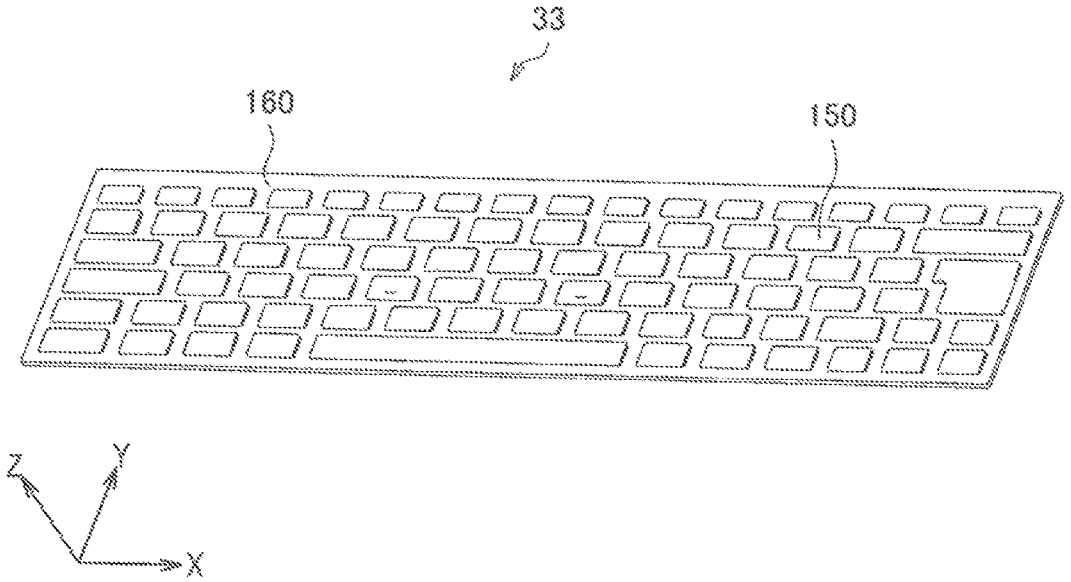
FIG. 3 is a perspective view illustrating an example of a configuration of a keyboard section 33 according to an embodiment.
Figure 4:
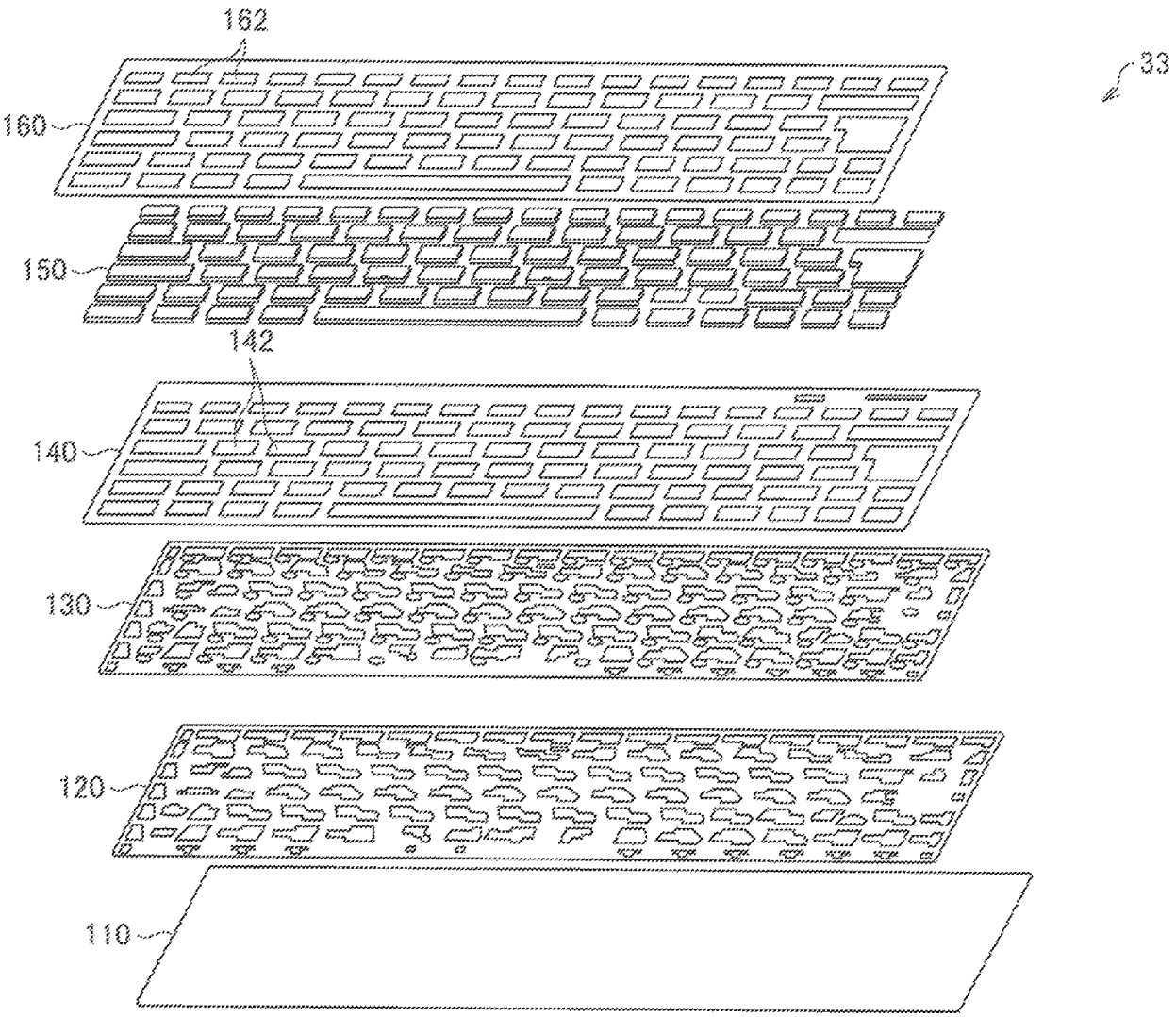
FIG. 4 is a perspective view illustrating a disassembled state of the keyboard section 33 according to an embodiment.

An example of a detailed configuration of the keyboard section 33 according to the first embodiment of the present disclosure will be described with reference to FIGS. 3 and 4. FIG. 3 is a perspective view illustrating an example of the configuration of the keyboard section 33 according to an embodiment. FIG. 4 is a perspective view illustrating a disassembled state of the keyboard section 33 according to an embodiment.

As illustrated in FIG. 4, the keyboard section 33 includes a bottom plate 110, a backlight member 120, a membrane 130, a support member 140, key tops 150, and a bezel 160. The keyboard section 33 is configured by stacking the backlight member 120, the membrane 130, the support member 140, and the key tops 150 in this order between the bottom plate 110 and the bezel 160.

(Bottom Plate 110)

The bottom plate 110 is provided on the bottom of the keyboard section 33. The bottom plate 110 is a plate-shaped member that has a flat-plate shape and is made of for example, a metal plate such as an aluminum plate, a resin, or the like. The bottom plate 110 supports the backlight member 120, the membrane 130, the support member 140, the key tops 150, and the bezel 160. Incidentally, similar to the bottom plate 110, the backlight member 120 and the membrane 130 have a flat-plate shape.

(Backlight Member 120)

For example, when the surroundings are dark, a light-emitting section of the backlight member 120 is turned on to illuminate the key tops 150 from the back side of the key tops 150. The brightness of the surroundings is sensed by for example, an illumination sensor. By providing the backlight member 120, the user can press down desired key tops 150 even when it is dark.

Figure 5:
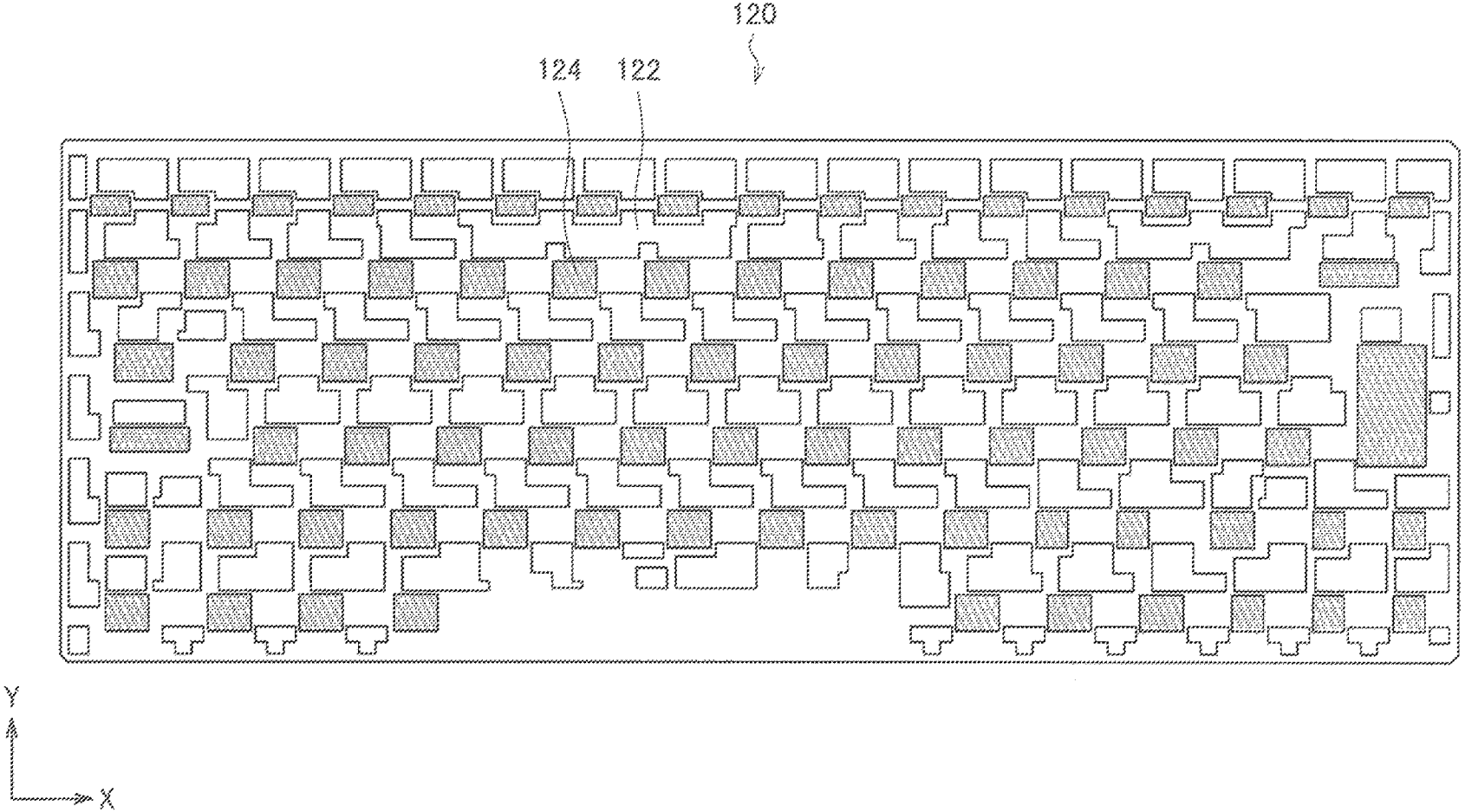
FIG. 5 is a diagram illustrating a configuration of a backlight member 120 according to an embodiment.

FIG. 5 is a diagram illustrating the configuration of the backlight member 120 according to an embodiment. As illustrated in FIG. 5, the backlight member 120 is a self-luminous light-emitting member having a sheet shape. Therefore, it is possible to illuminate the key tops 150 while reducing the thickness of the backlight member 120. The backlight member 120 includes a hole section 122 and a light-emitting section 124 (hatched portion in FIG. 5).

A plurality of hole sections 122 is formed at positions where magnets 156 or sliding sections 158 of the key tops 150 (see FIG. 7) to be described below are disposed. Specifically, the hole section 122 is an opening formed such that the magnet 156 and the sliding section 158 are entered when the key top 150 is pressed down. Therefore, since the magnet 156 and the sliding section 158 are entered into the hole section 122 when the key top 150 is pressed down, the key top 150 does not interfere with the backlight member 120, and the keyboard section 33 can be made thinner by the thickness of the backlight member 120.

The light-emitting section 124 is a self-luminous member, for example, an inorganic EL scheme. That is, the backlight member 120 is an inorganic EL light-emitting member. As many light-emitting sections 124 as the key tops 150 are formed at positions corresponding to the centers of the key tops 150. By using such an inorganic EL light-emitting section, it is possible to reduce the thickness of the backlight member 120 and uniformly emit light. In particular, in a case where the light-emitting section 124 is self-luminous, it is possible to make the key tops 150 emit light even though the hole sections 122 are provided, as opposed to an LED scheme in which requiring a waveguide plate.

Incidentally, in the above, the light-emitting section 124 has been described as being the inorganic EL scheme, but it is not limited thereto. For example, the light-emitting section 124 may be an organic EL scheme. That is, the backlight member 120 may be an organic EL light-emitting member. In such a case, the thickness of the backlight member 120 can be reduced. Also, the self-luminous backlight member 120 may be a thin sheet-shaped member in which ultra-low-profile LEDs are laid below the respective key tops 150.

(Membrane 130)

The membrane 130 is, for example, a switch including two sheets of film-shaped members and a contact formed by a pair of electrodes provided in inner surfaces of the film-shaped members to be faced at a predetermined interval. The contacts are disposed at positions corresponding to the key tops 150, respectively. When the contacts are contacted, electric signals corresponding to the key tops 150 are output through the signal lines.

Figure 6:
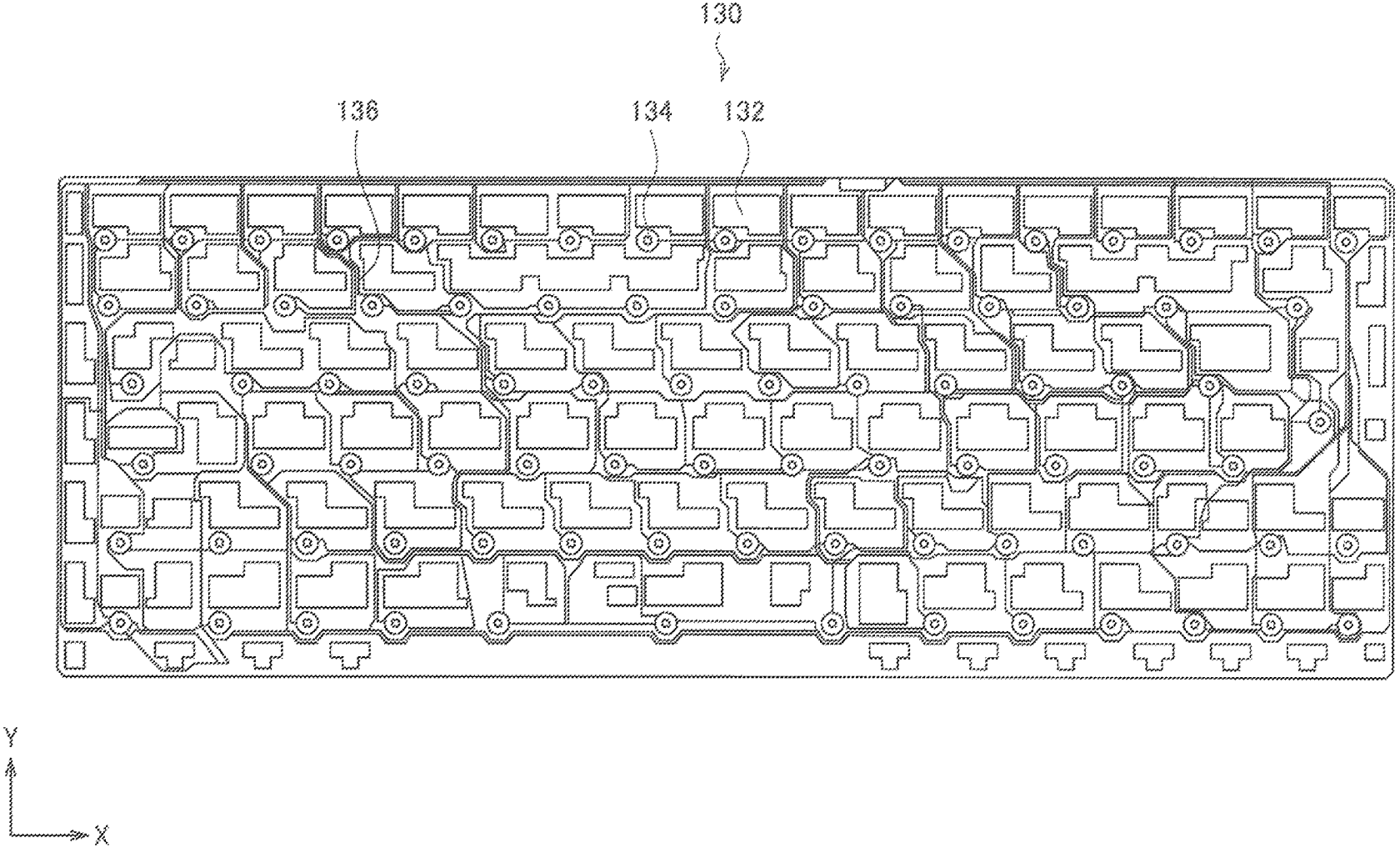
FIG. 6 is a diagram illustrating a configuration of a membrane 130 according to an embodiment.

FIG. 6 is a diagram illustrating the configuration of the membrane 130 according to an embodiment. As illustrated in FIG. 6, the membrane 130 includes hole sections 132, contacts 134, and signal lines 136. Incidentally, in an embodiment, the membrane 130 is an example of an opposing member facing the key tops 150.

Like the hole sections 122 of the backlight member 120, a plurality of hole sections 132 is formed at positions where magnets 156 and sliding sections 158 (see FIG. 7) of the key tops 150 to be described below are disposed. Specifically, the hole sections 132 have a function of a first opening formed such that the magnet 156 is entered when the key top 150 is pressed down and a function of a second opening formed such that the sliding section 158 is entered when the key top 150 is pressed down (see FIG. 10). In the present embodiment, the first opening and the second opening are formed to be connected to each other. By providing the hole sections 132, the magnet 156 and the sliding section 158 are entered into the hole sections 132 when the key top 150 is pressed down. Thus, the key top 150 does not interfere with the membrane 130 and the keyboard section 33 can be made thinner by the thickness of the membrane 130.

The contacts 134 are disposed in portions facing the key tops 150 (specifically, just below the key tops 150). When the key top 150 is pressed down, the back side of the key top 150 contacts the contact 134. Therefore, an electric signal corresponding to the pressed key top 150 is output.

The signal lines 136 are wired while avoiding the hole sections 132 in the membrane 130 and transfer electric signals. The signal lines 136 connect the contacts 134 to a keyboard controller of the keyboard section 33. Therefore, electric signals are output to the keyboard controller through the signal lines 136. Incidentally, as details will be described below, it is possible to appropriately wire the signal lines 136 within the membrane 130 by adjusting the formation positions of the hole sections 132 so as to reduce the thickness of the keyboard.

Incidentally, in the above, the membrane 130 has been described as being the switching scheme, but it is not limited thereto. For example, the membrane 130 may be a scheme that detects the proximity of the key top 150 or a pressure in a portion facing the key top 150. Also, the membrane 130 may adopt a scheme such as a position detection, a magnetic flux, or an electrostatic capacitance detection.

(Support Member 140)

The support member 140 is a support member that supports the plurality of key tops 150. Also, the support member 140 has a function of guiding the key top 150 in a predetermined moving direction when the user presses down the key top 150.

Figure 7:
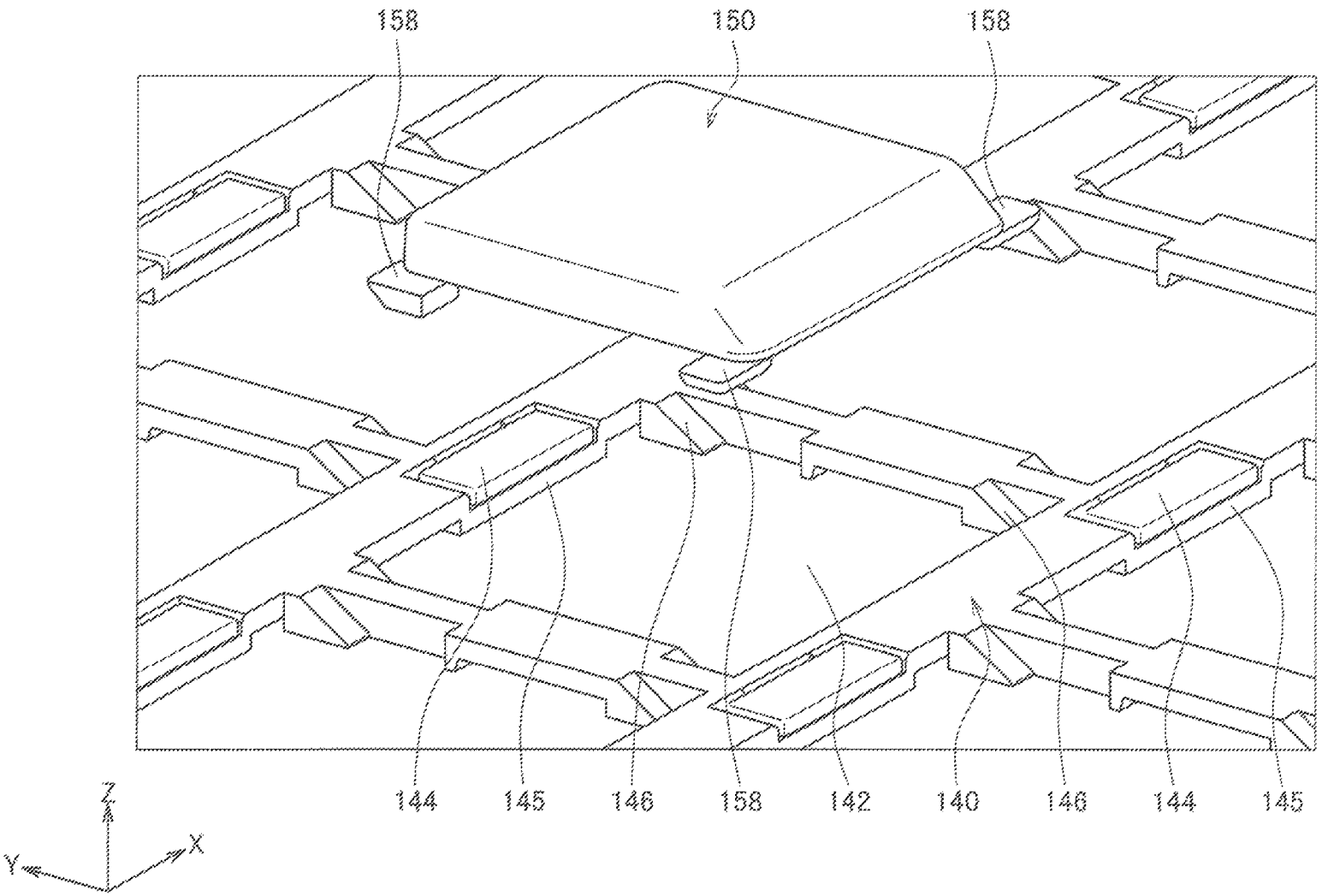
FIG. 7 is a perspective view illustrating an example of a configuration of a support member 140 and a key top 150 according to an embodiment.
Figure 8:
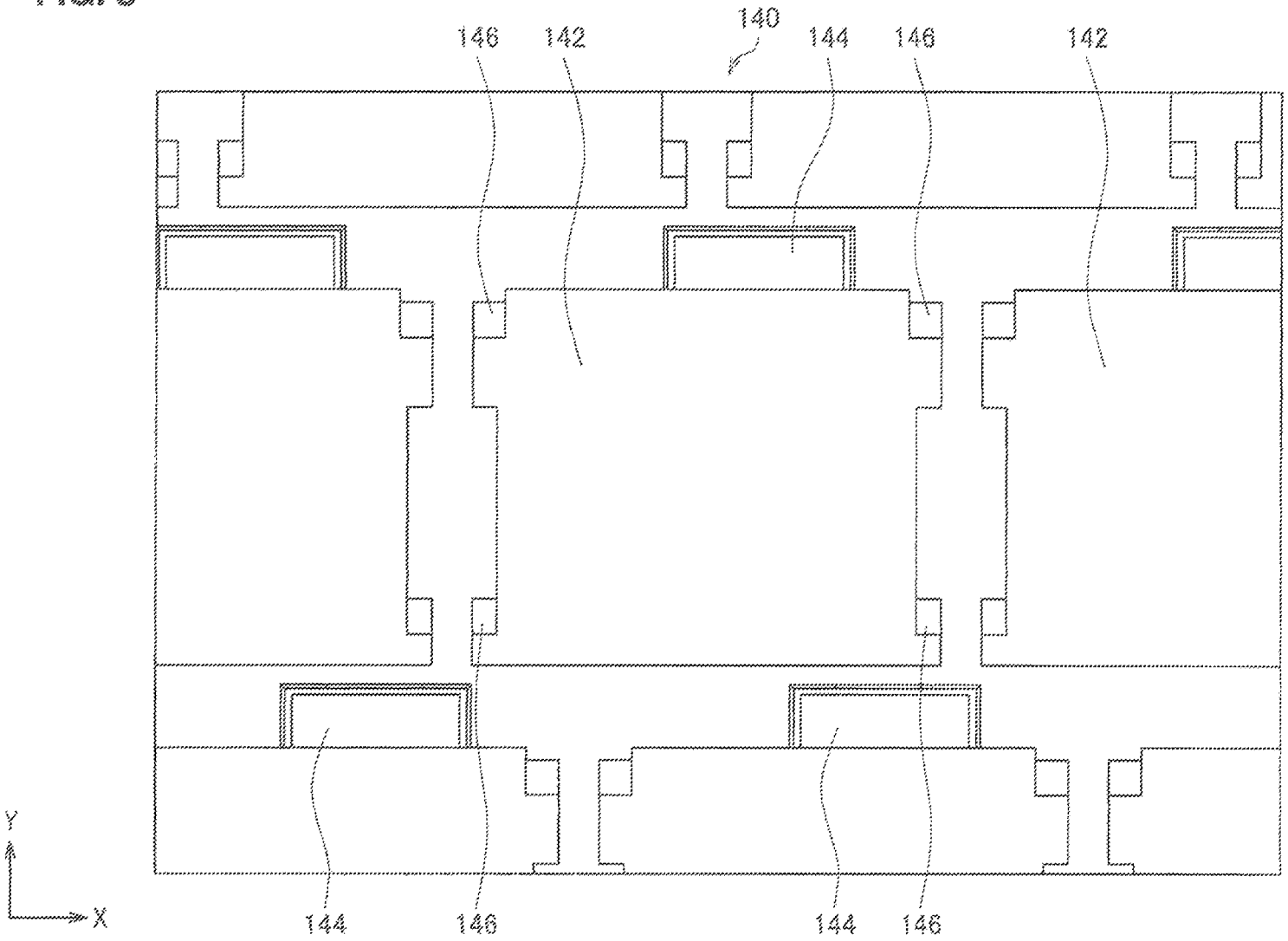
FIG. 8 is a plan view illustrating an example of a configuration of a support member 140 according to an embodiment.

FIG. 7 is a perspective view illustrating an example of the configuration of the support member 140 and the key top 150 according to an embodiment. FIG. 8 is a plan view illustrating an example of the configuration of the support member 140 according to an embodiment. Incidentally, only a part of the support member 140 is illustrated in FIGS. 7 and 8. Incidentally, in FIG. 7, for convenience of explanation, only one key top 150 is illustrated, and the key top 150 and the support member 140 apart from each other are illustrated. As illustrated in FIGS. 7 and 8, the support member 140 includes a hole section 142, a magnet 144, and a guide section 146.

The hole section 142 includes a hole that is formed in a rectangular shape at a position corresponding to the key top 150 and along a shape of the key top 150. Therefore, when the key top 150 is pressed down, the key top 150 is entered into the hole section 142.

The magnet 144 is provided at a position adjacent to the hole section 142. Specifically, the magnet 144 is provided at a position facing a magnet 156 provided in the key top 150. The magnet 156 is attracted to the magnet 144 by an attraction force generated between the magnet 144 and the magnet 156. Since the magnet 156 is attracted to the magnet 144, the key top 150 before being pressed is maintained at a reference position.

Incidentally the magnet 144 is fixed to a magnet fixing section 145 of the support member 140 (see FIG. 7). The magnet fixing section 145 protrudes toward the membrane 130 so as to ensure an attachment region of the magnet 144. In an embodiment, the protruding portion of the magnet fixing section 145 is entered into the hole section 132 of the membrane 130. Therefore, it is possible to prevent the magnet fixing section 145 from interfering with the membrane 130. As a result, the thickness of the keyboard section 33 can be reduced. That is, the hole section 132 of the membrane 130 also includes a function of a third opening formed at a portion facing the magnet 144.

The guide section 146 guides the sliding section 158 of the key top 150 such that the pressed key top 150 is moved obliquely downward. The key top 150 is maintained at a reference position (position P1 illustrated in FIG. 12) before pressing as described above, but when a pressing force to the key top 150 is large, the key top 150 can overcome the attraction force of the magnet and move to an input position (position P2 illustrated in FIG. 12). In the present embodiment, the guide section 146 is provided at each of four corners so as to smoothly move the key top 150.

Also, a guide surface 147 which is an inclined surface is formed in the guide section 146. The guide surface 147 is formed in a direction intersecting with a height direction (direction Z in FIG. 7) of the key top 150. When pressed down, the key top 150 is moved obliquely downward along the guide surface 147. Also, when the pressing to the key top 150 is released, the key top 150 is moved obliquely upward along the guide surface 147 by the attraction force of the magnet.

(Key Top 150)

As illustrated in FIG. 3, the key tops 150 are a plurality of operation key that are arranged in the keyboard section 33 horizontally and vertically. The operation keys are, for example, character or numeric keys, each of which has a rectangular shape. The plurality of key tops 150 are arranged adjacent to one another. When the key top 150 is pressed down from the reference position to the input position, a signal corresponding to the key top 150 is output.

The key top 150 is maintained at the reference position before being pressed down by the user, and is moved to the input position when being pressed down. The key top 150 is supported by the support member 140 such that the key top 150 is moved in a direction intersecting with the height direction of the key top 150 between the reference position and the input position. Since the configurations of the plurality of key tops 150 are identical to one another, the following description will be given of one key top 150 as an example with reference to FIG. 9.

Figure 9:
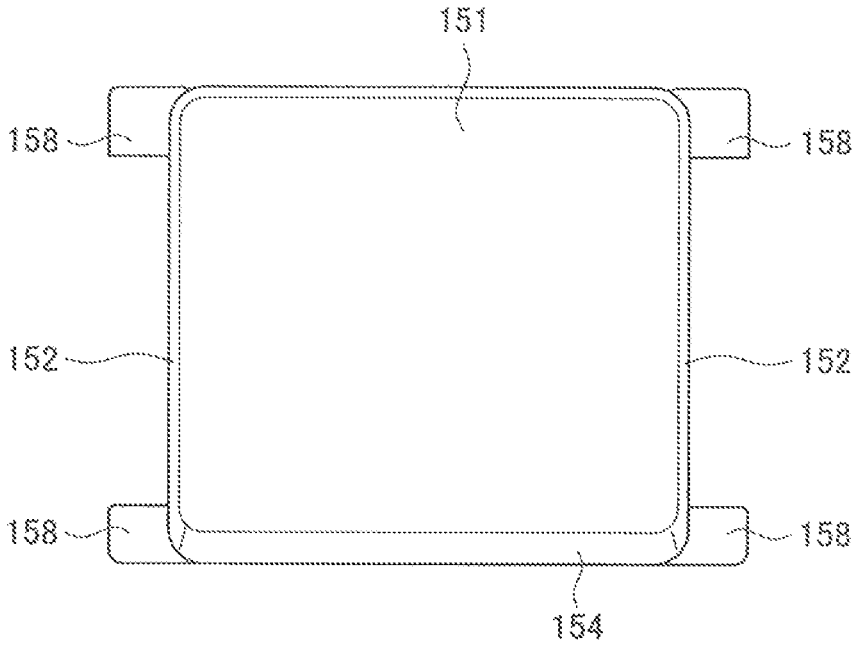
FIG. 9 is a diagram illustrating a configuration of a key top 150 according to an embodiment.
Figure 9:
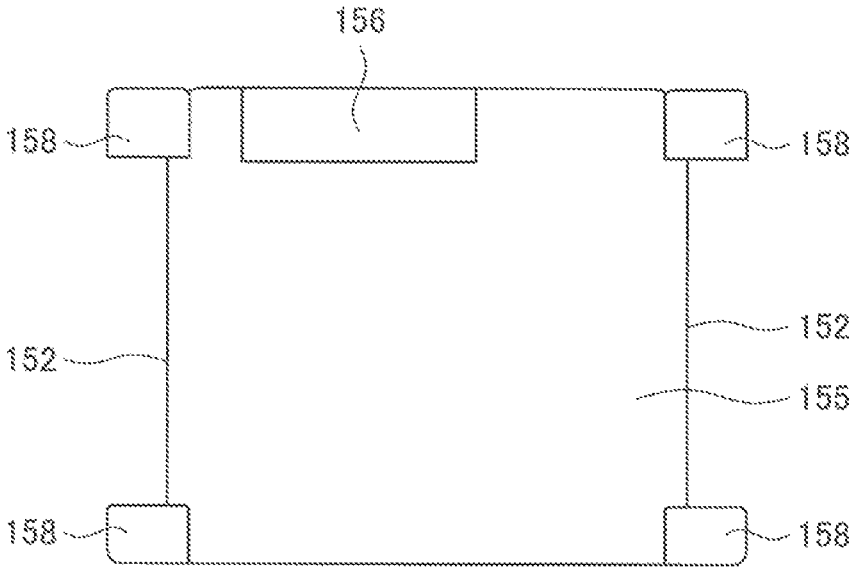

FIG. 9 is a diagram illustrating the configuration of the key top 150 according to an embodiment. Incidentally, FIG. 9A is a diagram of the key top 150 when viewed from the top surface side, and FIG. 9B is a diagram of the key top 150 when viewed from the bottom surface side. As illustrated in FIG. 9, the key top 150 includes a top surface 151, a magnet 156, and a sliding section 158.

The top surface 151 is a surface of the key top 150 which is pressed down by the user. An inclined surface 154 is formed at an edge of the top surface 151. Therefore, when the key top 150 is moved from the reference position to the input position, it is possible to prevent the key top 150 from contacting an inner edge of an opening 162 of the bezel 160 (FIG. 4).

The magnet 156 is fixed to a position facing the magnet 144 of the support member 140 so as to protrude from a back side 155 of the key top 150. The magnet 156 is attracted to the magnet 144 by the attraction force. Therefore, before pressed down, the key top 150 is maintained at the reference position where the magnet 156 is attracted to the magnet 144. On the other hand, when the pressing force to the key top 150 is large, the key top 150 overcomes the attraction force of the magnet and moves to the input position. Incidentally, in an embodiment, the magnet 156 corresponds to a first magnet and the magnet 144 corresponds to a second magnet. Incidentally, the reference position of the key top 150 corresponds to a first position and the input position corresponds to a second position.

Figure 10:
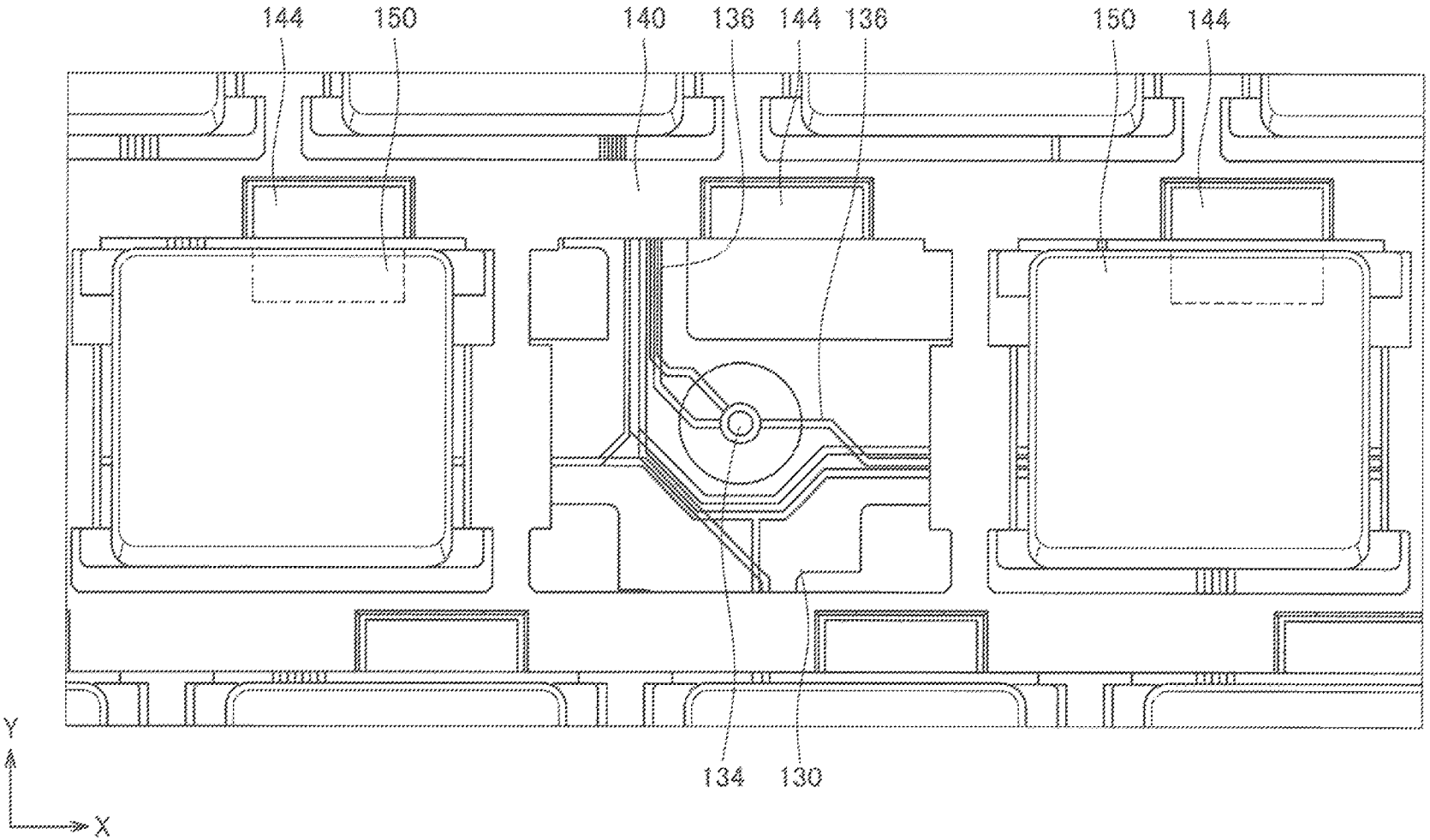
FIG. 10 is a diagram for describing a position of a magnet 156 according to an embodiment.

FIG. 10 is a diagram for describing the position of the magnet 156 according to an embodiment. The magnet 156 is disposed on the back side 155 of the key top 150 and is deviated in a width direction from the center to an end side. In other words, the magnet 156 is disposed to be deviated from the center of the accommodation space of the key top 150. Incidentally, for convenience of explanation, one key top 150 is not illustrated in FIG. 10.

When the key top 150 is pressed down, the sliding section 158 slides along the guide surface 147 of the support member 140. The sliding section 158 is a protrusion section that protrudes in a direction normal to a side surface of the key top 150. In an embodiment, four sliding sections 158 are formed such that the sliding sections 158 protrude in directions normal to both side surfaces 152 of the key top 150. When the sliding section 158 slides along the guide surface 147, the key top 150 moves between the reference position and the input position.

(Bezel 160)

The bezel 160 is a top cover of the keyboard section 33. In the bezel 160, as illustrated in FIG. 4, a plurality of openings 162 is formed such that the key tops 150 are arranged. The opening 162 has a hole with an area slightly larger than that of the arranged key top 150.

As described above, the keyboard section 33 according to an embodiment includes the magnet 144 provided in the support member 140, and the magnet 156 provided in the key top 150. A magnetic attraction force is generated between the magnet pair, and such attraction force holds the reference position of the key top 150. Therefore, as compared with the configuration using the rubber dome and the scissors mechanism, the thickness of the keyboard section 33 can be reduced.

Incidentally, a method of reducing a thickness of a rubber dome is also proposed. However, if the thickness of the rubber dome is reduced, the buckling characteristic of the rubber dome is deteriorated, and thus, a press feeling (also called a click feeling) of the key top provided to the user is deteriorated. Furthermore, if the thickness of the scissors mechanism is reduced, the strength of the scissors mechanism is lowered and the durability is impaired. In this regard, as in the case of an embodiment, if the magnets 144 and 156 are used instead of the rubber dome and the scissors mechanism, the deterioration of the click feeling can be suppressed and the strength of the scissors mechanism is not necessarily considered.

<3. Wiring of Signal Lines in Membrane 130>

As described above, the signal lines 136 for transferring signals are wired in the membrane 130. On the other hand, the plurality of hole sections 132 is formed over an entire region of the membrane 130 so as to reduce the thickness of the keyboard section 33 (see FIG. 6).

As described above, the hole section 132 functions as a first opening formed such that the magnet 156 is entered when the key top 150 is pressed down and a second opening formed such that the sliding section 158 is entered when the key top 150 is pressed down. The hole section 132 also functions as a third opening formed at a portion facing the magnet 144 of the support member 140. Since the plurality of hole sections 132 is formed in the membrane 130, a region where the signal lines 136 is to be wired is limited.

Figure 11:
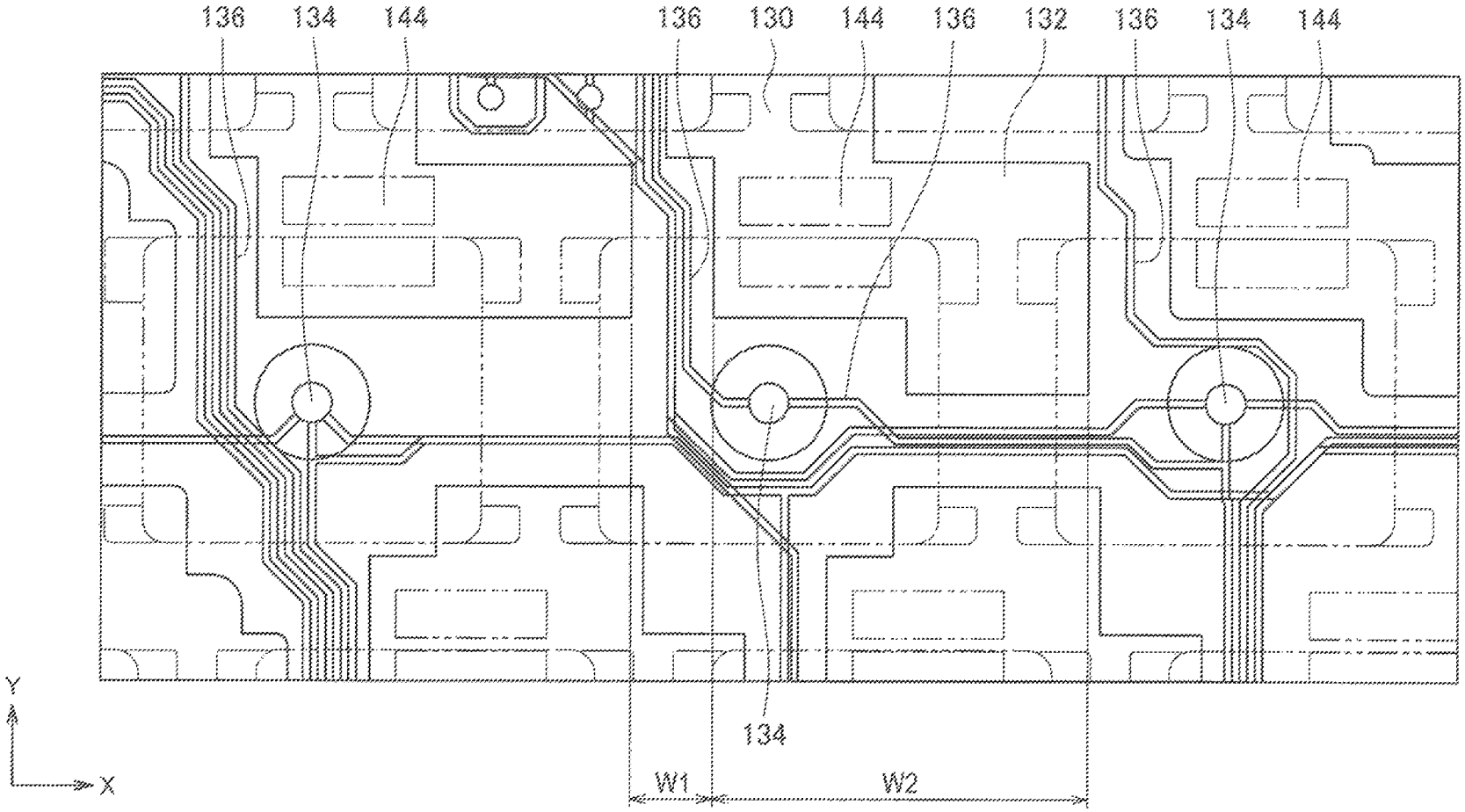
FIG. 11 is a diagram illustrating the wiring state of signal lines 136 according to an embodiment.

In the membrane 130 according to an embodiment, the signal lines 136 are wired as illustrated in FIG. 11.

FIG. 11 is a diagram illustrating the wiring state of the signal lines 136 according to an embodiment. As illustrated in FIG. 11, in the membrane 130 according to an embodiment, the signal lines 136 are wired while avoiding the hole sections 132. Specifically, the signal lines 136 are wired such that regions between the adjacent hole sections 132 in the membrane 130 are directed in an intersecting direction (Y direction of FIG. 11) that intersects with a width direction (X direction of FIG. 11) of the membrane 130.

Also, in order to wire the signal lines 136 in the intersecting direction described above, it is desirable to increase the width of the region between the adjacent hole sections 132 in the width direction. However, in the keyboard section 33 according to an embodiment, in order to densely arrange the key tops 150 from the viewpoint of reducing the width direction, the width (width W1 illustrated in FIG. 11) of the region where the signal line 136 between the adjacent hole sections 132 is wired in the width direction of the membrane 130 is smaller than the width (width W2 illustrated in FIG. 11) of the hole section 132.

By arranging the magnet 156 of the key top 150 to be deviated in the width direction of the key top 150 to one end side as illustrated in FIG. 10, it is possible to ensure the region where the signal line between the adjacent hole sections 132 is wired as illustrated in FIG. 11. Therefore, even when the hole section 132 is formed in the membrane 130, the signal line 136 can be appropriately wired in the intersecting direction. On the other hand, if the magnet 156 is disposed at the center of the key top 150 in the width direction, the width of the region between the adjacent hole sections 132 may not be sufficiently ensured, and thus, the signal line 136 may not be appropriately wired.

<4. Example of Movement of Keyboard Section 33>

Figure 12:
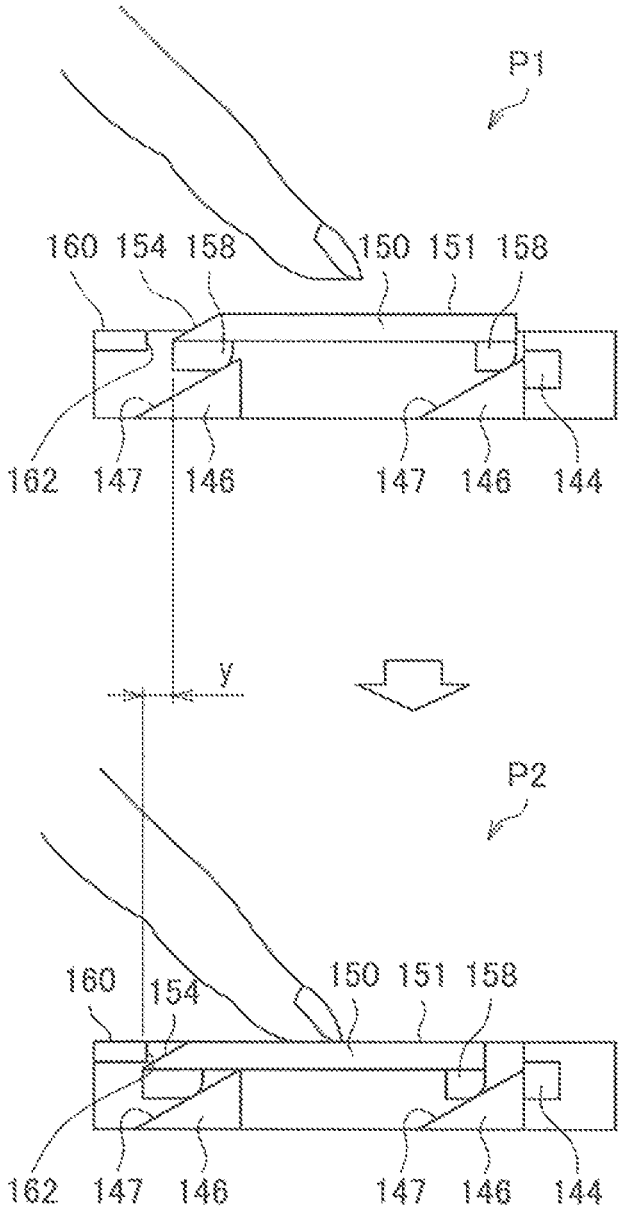
FIG. 12 is a diagram for describing an example of a movement of a keyboard section 33 when a user presses down a key top 150.

An example of the movement of the keyboard section 33 when a user presses down the key top 150 will be described with reference to FIG. 12. FIG. 12 is a diagram for describing an example of the movement of the keyboard section 33 when a user presses down the key top 150.

Herein, since the magnet 156 is attracted to the magnet 144 of the support member 140, the key top 150 is located at the reference position P1. In this state, the user presses down the top surface 151 of the key top 150 with a finger in order to input with the key top 150.

When the pressing force to the top surface 151 is small, the key top 150 is not moved, and when the pressing force is large, the key top 150 overcomes the attraction force of the magnet and starts to move obliquely downward. Specifically, the key top 150 is moved along the guide surface 147 of the support member 140 in a direction from a back side to a front side when viewed from the user.

At this time, since the inclined surface 154 is formed at the edge of the key top 150, when the key top 150 is moved along the guide surface 147, the edge of the key top 150 does not interfere with the inner edge of the opening 162 of the bezel 160. As a result, the key top 150 is smoothly moved by a movement amount y from the back side to the front side as illustrated in FIG. 12 and is located at the input position P2.

When the key top 150 is located at the input position P2, the magnet 156 and the sliding section 158 are entered into the hole section 132 of the membrane 130. Therefore, the magnet 156 or the sliding section 158 does not interfere with the membrane 130. When the key top 150 is located at the input position P2, the key top 150 contacts the contact 134 of the membrane 130. Therefore, electric signals are transferred from the membrane 130 through the signal lines 136 to the keyboard controller.

When the pressing to the top surface 151 is released, the key top 150 located at the input position P2 is moved upward along the guide surface 147 by the attraction force between the magnet 156 and the magnet 144. The key top 150 is located at the reference position P1 where the magnet 156 is attracted to the magnet 144.

<5. Summary>

In the above-described electronic device 10, the membrane 130 includes the plurality of openings 132 formed corresponding to the positions where the magnets 156 are located when the key tops 150 are pressed down. Therefore, since the magnet 156 does not interfere with the membrane 130, the reduction in the thickness of the keyboard section 33 can be achieved. Also, the signal lines 136 are wired while avoiding the openings 132 in the membrane 130. Therefore, it is possible to appropriately output the signals according to the pressing of the key tops 150.

The preferred embodiments of the present disclosure have been described in detail with reference to the appended drawings, but the technical scope of the present disclosure is not limited to such examples. It should be understood by those skilled in the art that various modification or alteration examples may occur within the scope of technical ideas described in the appended claims and that such examples are also naturally within the technical scope of the present disclosure.

Incidentally, in the above, the opposing member has been assumed as the membrane 130 with the contacts 134 and the signal lines 136, but is not limited thereto. For example, the opposing member may be a sheet-shaped member in which the signal lines are wired without any contacts.

Also, the effects described herein are only for illustrative or explanatory purposes, not limiting purposes. That is, the technologies according to the present disclosure can achieve other effects apparent to those skilled in the art from the description of the present specification, in addition to the above effects or alterative to the above effects.

Additionally, the present technology may also be configured as below.

(1) A keyboard device including:

a plurality of key tops that include magnets and are depressible;

an opposing member which is provided to face the plurality of key tops and in which signal lines are wired; and a plurality of openings that is formed corresponding to positions of the magnets when the key tops are pressed in the opposing member, wherein the signal lines are wired while avoiding the plurality of openings.

(2) The keyboard device according to (1), wherein the magnets are disposed on back sides of the key tops and are deviated in a width direction from a center to an end side.

(3) The keyboard device according to (1) or (2), wherein the signal lines are wired such that regions between the adjacent openings in the opposing member are directed in an intersecting direction that intersects with a width direction of the opposing member.

(4) The keyboard device according to (3), wherein in the width direction of the opposing member, a width of the region where the signal line between the adjacent openings is wired is smaller than a width of the opening.

(5) The keyboard device according to any one of (1) to (4), wherein the opposing member is a membrane switch which includes contacts in portions facing the key tops and in which the signal lines are connected to the contacts.

(6) The keyboard device according to any one of (1) to (5), wherein the key tops include protrusion sections that protrude in a direction normal to a side surface, wherein the keyboard device further includes a support member that supports the protrusion section between the key top and the opposing member, wherein the opening is a first opening, and wherein the opposing member includes a plurality of second openings formed at positions corresponding to positions of the protrusion sections when the key tops are pressed down.

(7) The keyboard device according to (6), wherein the magnet is a first magnet, wherein the support member includes a second magnet to which the first magnet is attracted, and wherein the opposing member includes a plurality of third openings formed in a portion facing the second magnet.

(8) The keyboard device according to (7), wherein the support member guides the protrusion section between a first position where the first magnet is attracted to the second magnet and a second position where the attraction by pressing is released, such that the key tops are moved in a moving direction intersecting with a height direction of the key tops.

(9) The keyboard device according to any one of (1) to (8), further including:

a self-luminous light-emitting member that has a sheet shape and illuminates the key tops from a back side of the key tops.

(10) The keyboard device according to (9), wherein the light-emitting member is an inorganic EL light-emitting member or an organic EL light-emitting member.

(11) The keyboard device according to (9) or (10), wherein the light-emitting member includes a plurality of openings that is formed at positions corresponding to positions of the magnets when the key tops are pressed down.

What is claimed is:

1. A keyboard device comprising:

a plurality of key tops that include a plurality of first magnets, wherein each first magnet of the plurality of first magnets is disposed in a position on a respective key top of the plurality of key tops that is deviated in a longitudinal width direction from a center to a first end side of the respective key top, and wherein the plurality of key tops are depressible in a vertical direction;

a plurality of second magnets;

an opposing member which is provided to face the plurality of key tops and in which signal lines are wired; and a plurality of openings formed in the opposing member, wherein the plurality of openings are respectively located at positions of the plurality of first magnets, wherein each second magnet of the plurality of second magnets is positioned horizontally adjacent to a corresponding first magnet of the plurality of first magnets and within a respective opening of the plurality of openings, and wherein the signal lines are wired below the plurality of key tops while avoiding the plurality of openings by being deviated in the longitudinal width direction from the center to a second end side of each respective key top.

2. The keyboard device according to claim 1, wherein the plurality of first magnets are disposed on back sides of the plurality of key tops.

3. The keyboard device according to claim 1, wherein the signal lines are wired such that regions between adjacent openings of the plurality of openings in the opposing member are directed in an intersecting direction that intersects with the longitudinal width direction of the opposing member.

4. The keyboard device according to claim 3, wherein in the longitudinal width direction of the opposing member, a width of the region where the signal line between the adjacent openings is wired is smaller than a width of each opening of the adjacent openings.

5. The keyboard device according to claim 1, wherein the opposing member is a membrane switch which includes contacts in portions facing the plurality of key tops and in which the signal lines are connected to the contacts.

6. The keyboard device according to claim 1, wherein the plurality of key tops include protrusion sections that protrude in a direction normal to a side surface, wherein the keyboard device further comprises a support member that supports the protrusion section between each key top of the plurality of key tops and the opposing member, wherein the plurality of openings are a plurality of first openings, and wherein the opposing member includes a plurality of second openings formed at positions corresponding to positions of the protrusion sections when the plurality of key tops are pressed down.

7. The keyboard device according to claim 6, wherein the support member includes the plurality of second magnets to which the plurality of first magnets are attracted, and wherein the opposing member includes a plurality of third openings formed in a portion facing the second magnet.

8. The keyboard device according to claim 7, wherein the support member guides the protrusion section between a first position where the plurality of first magnets are attracted to the plurality of second magnets and a second position where the attraction by pressing is released, such that the plurality of key tops are moved in a moving direction intersecting with a height direction of the plurality of key tops.

9. The keyboard device according to claim 1, further comprising:

a self-luminous light-emitting member that has a sheet shape and illuminates the plurality of key tops from a back side of the plurality of key tops.

10. The keyboard device according to claim 9, wherein the light-emitting member is an inorganic EL light-emitting member or an organic EL light-emitting member.

11. The keyboard device according to claim 9, wherein the light-emitting member includes a plurality of second openings that are formed at positions corresponding to positions of the plurality of first magnets when the plurality of key tops are pressed down.

12. The keyboard device according to claim 1, wherein each first magnet of the plurality of first magnets is positioned on the respective key top of the plurality of key tops so as to face a respective second magnet of the plurality of second magnets prior to the key top being depressed.

* * * * *